US006233977B1

(12) United States Patent
Schuler et al.

(10) Patent No.: US 6,233,977 B1
(45) Date of Patent: May 22, 2001

(54) COMPOUND NEEDLE HAVING A DIVIDED CLOSING ELEMENT

(75) Inventors: Bernhard Schuler, Sonnenbühl-Erpfingen; Klaus Ruoff, Albstadt, both of (DE)

(73) Assignee: Groz-Beckert AG, Albstadt (DE)

( * ) Notice: Subject to any disclaimer, the term of this patent is extended or adjusted under 35 U.S.C. 154(b) by 0 days.

(21) Appl. No.: 09/534,571

(22) Filed: Mar. 27, 2000

(30) Foreign Application Priority Data

Mar. 26, 1999 (DE) ..... 199 13 822

(51) Int. Cl.[7] ..... D04B 35/06
(52) U.S. Cl. ..... 66/120; 66/123
(58) Field of Search ..... 66/116, 120, 123, 66/124

(56) References Cited

U.S. PATENT DOCUMENTS

| | | | | |
|---|---|---|---|---|
| 1,673,634 | | 6/1928 | Page . | |
| 3,449,930 | * | 6/1969 | West et al. | 66/120 |
| 3,584,481 | * | 6/1971 | Hayashi | 66/120 |
| 4,043,153 | * | 8/1977 | Lindner et al. | 66/120 |

FOREIGN PATENT DOCUMENTS

| | | |
|---|---|---|
| 44 30 705 | 3/1996 | (DE) . |
| 0 875 614 | 11/1998 | (EP) . |
| 0 881 314 | 12/1998 | (EP) . |

* cited by examiner

*Primary Examiner*—Danny Worrell
(74) *Attorney, Agent, or Firm*—Venable; Gabor J. Kelemen

(57) ABSTRACT

A compound needle includes a shank having an end; a hook formed on the shank at the shank end and having a hook tip; and a closing element slot provided in the shank and being defined by two parallel shank flanks. The closing element slot extends from a location adjacent the hook in a direction away therefrom. The compound needle further has an elongated closing element received in the closing element slot for longitudinal sliding motions therein. The closing element has a hook-closing position in which the closing element is situated in an immediate vicinity of the hook tip. The closing element is composed of at least two side-by-side disposed, resilient closing element parts each having a free terminal leg oriented toward the hook. The terminal legs are bent away from one another to define a relatively narrow funnel having an open end oriented toward the hook and a beginning spaced from the open funnel end. The closing element parts are bent away from one another from the beginning of the funnel in a rearward direction away from the hook for resiliently contacting respective slot flanks at contact locations. The contact locations are situated adjacent the beginning of the closing element slot when the closing element is in its hook-closing position.

11 Claims, 6 Drawing Sheets

COMPOUND NEEDLE HAVING A DIVIDED CLOSING ELEMENT

CROSS REFERENCE TO RELATED APPLICATION

This application claims the priority of German Application No. 199 13 822.2 filed Mar. 26, 1999.

BACKGROUND OF THE INVENTION

This invention relates to a compound needle particularly for use in loop-forming textile machines.

Knitting machines and similar loop-forming textile machines use compound needles whose hook may be closed by a closing element. The closing element is guided and controlled in such a manner that it may move onto and away from the needle hook for securely maintaining the threads captive in the needle hook. Further, the closing element can close the hook to allow the loop to glide on its exterior (knockover step). In case the closing element is displaced further outwardly beyond the hook, the loops transferred to the closing element may be taken over by other needles (loop transfer step).

Loop-forming textile machines must form the desired loops with the highest degree of reliability. Even only sporadic operational defects immediately spoil the quality of the produced fabric to an unacceptable extent. Further, the loop formation has to occur at a high speed to ensure an acceptable output rate. The loop-forming process, despite the high speed, must not be affected, to the greatest extent possible, by operational disturbances such as changing pulling forces exerted on the thread caused, for example by the predetermined pattern, non-uniform thread thickness or other influences.

Further, the compound needles should be exposed to as little wear as possible to ensure a reliable operation over a long service period, and to keep maintenance periods and down times relatively short.

U.S. Pat No. 1,673,634 discloses a compound needle having a divided closing element. The closing element is composed of two thin, resilient sheet metal closing element parts coupled to one another. The two closing element parts are, as a unit, longitudinally displaceably mounted in a closing element slot which is provided in the needle shank and which begins in the vicinity of the needle hook. The two free terminal leg portions of the closing element projecting from the closing element slot define a funnel which receives the tip of the needle hook when the closing element has been shifted to a position in the vicinity of the needle hook. For this purpose, the two free leg portions of the closing element are slightly bent away from one another. In addition, the leg portions are constructed such that they tend to resiliently move away from one another as they emerge from the closing element slot.

SUMMARY OF THE INVENTION

It is an object of the invention to provide an improved compound needle having a greater operational reliability than conventional compound needle structures.

This object and others to become apparent as the specification progresses, are accomplished by the invention, according to which, briefly stated, the compound needle includes a shank having an end; a hook formed on the shank at the shank end and having a hook tip; and a closing element slot provided in the shank and being defined by two parallel shank flanks. The closing element slot extends from a location adjacent the hook in a direction away therefrom. The compound needle further has an elongated closing element received in the closing element slot for longitudinal sliding motions therein. The closing element has a hook-closing position in which the closing element is situated in an immediate vicinity of the hook tip. The closing element is composed of at least two side-by-side disposed, resilient closing element parts each having a free terminal leg oriented toward the hook. The terminal legs are bent away from one another to define a funnel having an open end oriented toward the hook and a beginning spaced from the open funnel end. The closing element parts are bent away from one another from the beginning of the funnel in a rearward direction away from the hook for resiliently contacting respective slot flanks at contact locations. The contact locations are situated adjacent the beginning of the closing element slot when the closing element is in its hook-closing position.

The compound needle according to the invention has a divided or slotted closing element which is conventionally composed of two or more closing element parts. Embodiments are feasible in which the closing element is formed of a single slotted component.

The closing element parts or closing element regions separated by a gap are biased resiliently away from one another in the installed state. In this arrangement not only the leg portions which form the funnel are resiliently moving but also the parts or regions adjoining the funnel. This is achieved by a lateral resilient bulging of the closing element parts which at other locations are connected fixedly with one another or constitute a one piece component. In the region which adjoins the funnel, the closing element parts are, however, not connected with one another to ensure that they may move resiliently freely away from one another. The curvature of the two closing element parts is designed such that the zones thereof which immediately adjoin the funnel are in contact with the flanks of the closing element slot. The thus-obtained bilateral locations of contact form guiding or supporting locations for the closing element and thus center it in the closing element slot.

The guiding and supporting locations are situated very close to the free end of the closing element as a result of a suitable bend of the closing element parts. If the closing element is in the hook-closing position, the regions of the closing element which form the contact locations are situated in the zone of the beginning of the closing element slot. The contact locations of the closing element are situated such that when the closing element is in the loop transfer position, that is, it is shifted outwardly beyond the needle hook, at least portions of the contact locations project from the closing element slot. In an embodiment of the invention such contact locations of the closing element already reach the beginning of the closing element slot when the closing element assumes its knockover position. Preferably, however, these regions already reach the beginning of the closing element slot as the closing element assumes its hook-closing position.

By the particular bending of the closing element parts a small distance between the contact locations and the free end of the closing element is obtained. This makes possible an accurate guidance of the free end of the closing element and thus the formation of a very narrow funnel. An accurate guidance of the closing element at or in the compound needle makes possible a secure introduction of the hook tip into the funnel even if the funnel mouth is very narrow. Even in case of forces which are laterally exerted on the free ends of the closing element, for example, a lateral thread pull, the closing element legs which define the funnel are not deflected to such an extent that upon closing the needle hook they would collide with the hook tip; in this manner wear is reduced.

Further, a narrow funnel ensures a secure gliding of the loops over the hook during knockover which, similarly to a secure opening and closing of the closing element, enhances the operational reliability.

A further advantage is derived from the reduction of the funnel size by improving the guidance of the closing element in the closing element slot. A smaller funnel provides for a low-friction run of the closing element in the closing element slot, particularly when the funnel enters into the closing element slot upon withdrawing the closing element. This arrangement, in turn, makes possible to design the closing element slot to be relatively narrow, that is, the play between the closing element and the closing element slot can be minimized. A small play, in turn, increases the positioning reliability and thus the operational reliability of the compound needle.

By virtue of the bend in the closing element parts according to the invention, the closing element is centered in the closing element slot, that is, it is centrally guided. Both closing element parts are in contact with the respective flanks of the closing element slot. The engagement is localized and is set in a defined manner. Upon a reciprocating motion of the closing element during operation of the compound needle both flanks of the closing element slot are continuously wiped; as a result, dirt deposits are avoided and thus the closing element slot is maintained clean. Such a result enhances the operational safety of the compound needle.

The two closing element parts are preferably of symmetrical construction and contact one another at the end or at the bottom of the funnel. Due to such an arrangement the adjoining bulging portions of the closing element parts are to some extent in a dual engagement with one another, that is, at the end of the funnel and at a location which is situated deeper in the closing element slot. As a result, sufficient spring forces are obtained even in case of only slight initial bending of the closing element parts. Further, the closing element parts may be very thin.

The desired lateral bend of the closing element parts may be obtained, if required, by a single bend situated adjacent the funnel. The location of bend sets the guiding and supporting location approximately at the beginning of the closing element slot. According to a further, improved embodiment, at each closing element part, however, two spaced bending locations are provided; as a result, the lateral bulging runs out flat, so that the contact between each closing element part and the respective flank of the closing element slot is a flat, face-to-face engagement. This enhances a reduction of closing element wear due to friction.

A further advantage of an embodiment having two bending locations resides in that the closing element may be shifted beyond the needle hook into a loop-transfer position without the two closing element parts being spread away from one another to an excessive extent.

The guidance of the closing element portion projecting from the closing element slot is effected essentially at the beginning of the closing element slot preferably in each position of the closing element, that is, in the open, loop-holding, knockover or loop-transfer positions. In this manner, the length of that portion of the closing element which extends beyond the supporting location is minimized which improves the accuracy of the guidance and thus contributes to an increased operational reliability.

In advantageous embodiments of the invention, the closing element slot is narrow and amounts to less than three times the thickness of one of the closing element parts. The laterally possible resilient excursion of the funnel formed by the two closing element parts is thus maintained small.

DESCRIPTION OF THE PREFERRED EMBODIMENTS

Figure 1:
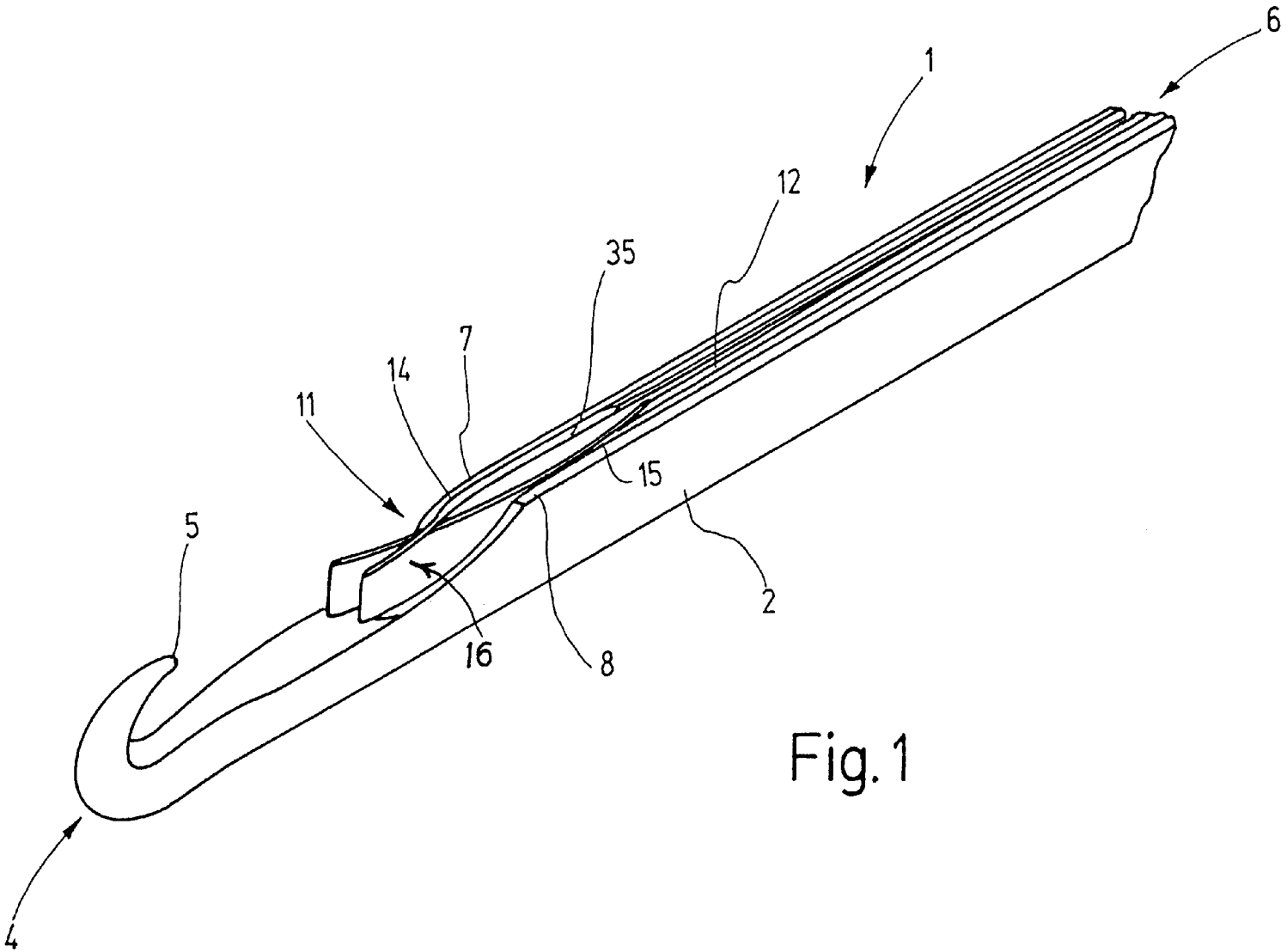
FIG. 1 is a schematic fragmentary perspective view of a compound needle according to the invention.

FIG. 1 illustrates a compound needle 1 having a shank 2 carrying a hook 4 at one end. The hook 4 which terminates in a slightly rounded tip 5 is tapered, as particularly well seen in FIG. 2. As a rule, the tip 5 lies in a symmetry plane of the shank 2. If required, the compound needle 1 may be arcuate, angled or bent in a lateral direction.

The shank 2 has a closing element slot 6 which is bounded by two slot walls 7, 8. The slot walls 7, 8 have parallel spaced inner faces 9, 10 (both seen in FIG. 2) which constitute the flanks of the closing element slot 6. The closing element slot 6 runs out flat on its side oriented towards the hook 4 as the height of the slot walls 7, 8 are gradually reduced to zero. The beginning 11 of the closing element slot 6 is situated in a region in which the slide slot walls 7, 8 have reached a sufficient height for guiding a closing element 12 accommodated in the closing element slot 6. Such a height is attained at a transitional location 14 after which the height of the slot walls 7, 8 remains constant along the shank 2, at least within a region adjacent to location 14. In case a height which is sufficient for the guidance of the closing element 12 is reached earlier, such location may be considered as the beginning 11 of the closing element slot 6.

Figure 6:
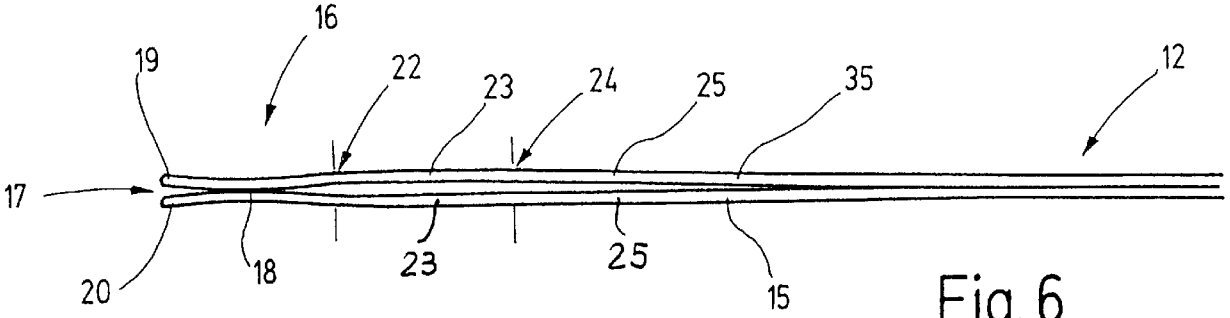
FIG. 6 is a top plan view of the closing element of the compound needle of FIGS. 1–5, illustrated in the relaxed state.

As it may be observed in FIG. 1, the closing element 12 is formed of two closing element parts 35 and 15 which are symmetrical to one another with respect to the longitudinal symmetry plane of the shank 2. FIG. 6 separately shows the two closing element parts 35 and 15; a portion of the closing element part 35 is illustrated greatly enlarged in FIG. 7. Due to the symmetry of the two closing element parts 35, 15, the description of the closing element part 35 which follows equally applies to the closing element part 15.

Figure 3:
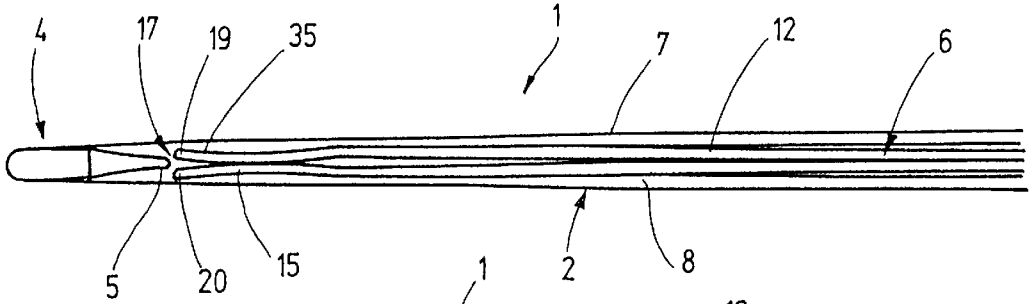
FIG. 3 is a top plan view of the construction shown in FIG. 1, illustrating the closing element in the hook-closing position.
Figure 7:
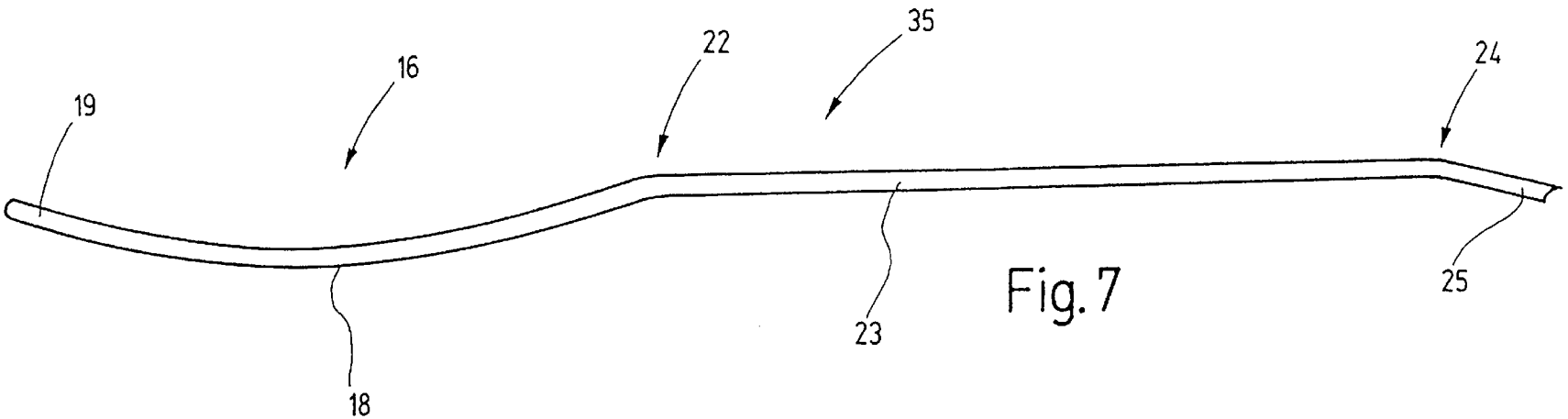
FIG. 7 is a top plan view of one part of the closing element of FIG. 6 shown on an enlarged scale.

As it may be well observed particularly in the enlarged FIG. 7, at its free end 16 the closing element part 35 is circularly concavely bent as viewed from the outside of the closing element. As a result, at their end the two closing element parts 35, 15 form an open funnel 17 defined by two legs 19, 20. The funnel 17, as shown in FIG. 1 or 3, is oriented towards the hook tip 5 and is adapted to receive the hook 4 or at least its tip 5. The legs 19, 20 engage one another at a contact location 18 from which the legs 19 and 20 diverge from one another until they reach the outer funnel end whose width approximately corresponds to the diameter of the hook tip 5. This arrangement is particularly well seen in FIG. 3 which shows the compound needle 1 in its closed position (hook-closing position) in which the free ends of the legs 19, 20 are located immediately at or in front of the hook tip 5.

From the contact location 18 rearwardly of the outer funnel end, the approximately circular bent closing element parts 35, 15 once again diverge until a first bending location 22. The portions 23 of the closing element parts 35, 15 extending rearwardly from the bending location 22 are essentially linear. The portion 23 of each closing element part 35, 15 forms an obtuse angle with the rearward end portion 16 of the respective closing element leg 19, 20. The transition from the legs 19, 20 to the respective straight portion 23 may occur at a sharp bend line (kink line) or a gently curved region.

Further rearwardly from the free end 16 of the closing element 12 an additional straight region 25 of the respective closing element parts 35, 15 adjoins the respective linear portion 23 at a bending location 24. The portion 23 and the region 25 form an obtuse angle with one another. Preferably, such an angle is slightly larger than the angle at the bending location 22. In the relaxed state (FIG. 6) the closing element parts 35, 15 have the greatest separation from one another preferably at the bending location 24. At the bending location 22 also, the distance between the outer faces of the closing element parts 35, 15 is greater than the width of the closing element slot 6. By virtue of the bend the closing element parts 35, 15 are resiliently movable away from one another in a region adjoining the funnel 17 and the contact location 18 and toward one another in a region of the funnel.

If the closing element 12 consisting of the parts 35, 15 is inserted into the closing element slot 6 of the compound needle 1, the closing element parts 35, 15 resiliently move slightly towards one another in the region 23. As seen in FIG. 3, the closing element parts 35, 15 lie directly against the flanks 9, 10 of the closing element slot 6 at the beginning 11 thereof. Such an engagement is a face-to-face contact and is preferably limited to a frontal region (for example, the portion 23) of the closing element 12. In this manner the closing element 12 is centered in the closing element slot 6. As may be observed in FIG. 3, the funnel 17 is located centrally in front of the hook tip 5.

In the description which follows, the operation of the above-described compound needle 1 will be set forth.

Figure 4:
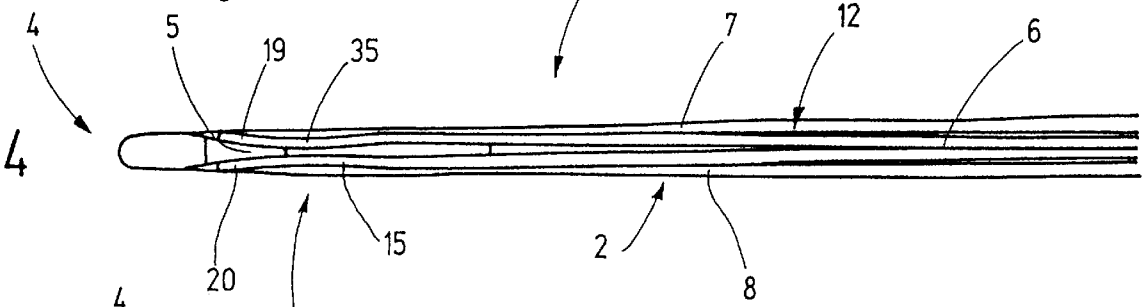
FIG. 4 is a top plan view of the compound needle of FIG. 1, illustrating the closing element in the knockover position.

During operation the compound needle 1 of a loop-forming machine travels parallel to its longitudinal axis, while the closing element 12 is moved longitudinally within the closing element slot 6 relative to the needle shank 2. The closing element 12 is moved, for example, from the hook-closing position as shown in FIG. 3, into the knockover position illustrated in FIG. 4. During this occurrence the closing element 12 is held centered in the closing element slot 6, and the legs 19, 20 of the funnel 17 move laterally beyond the tip 5 and thus close the hook 4. By virtue of the narrow opening width of the funnel 17, the legs 19, 20 lie closely on the hook 4 and thus project laterally therefrom only very slightly, if at all. Thus, a smooth external contour is obtained over which the loops may easily slide or may be easily knocked over.

Figure 2:
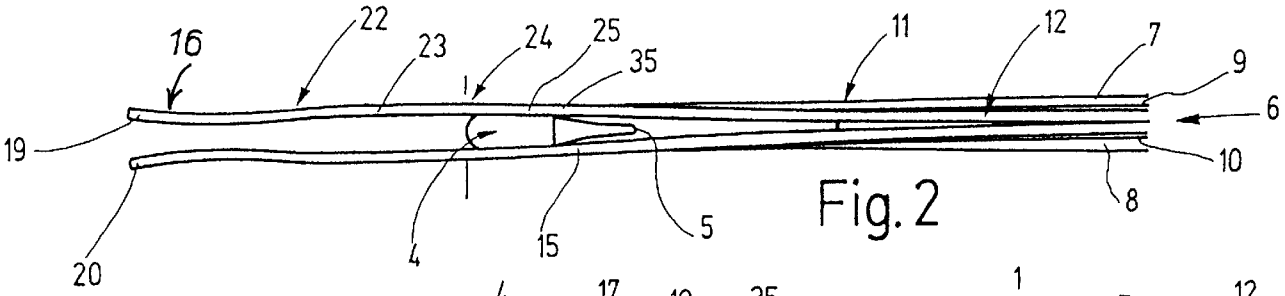
FIG. 2 is a top plan view of the compound needle of FIG. 1, illustrating the closing element in the transfer position.

By means of a further forward shift of the closing element 12 relative to the hook 4, the compound needle 1 may assume its transfer position as illustrated in FIG. 2. During this occurrence the closing element parts. 35, 15 move laterally past the hook 4 and are spread apart at the same time. By virtue of the bend defined by the bending locations 22 and 24, the regions 23 of the closing element parts 35, 15 extend beyond the hook 4 approximately parallel to one another away from the hook 4. The guidance of the closing element 12 is determined by the cooperation of contact locations at the beginning 11 of the closing element slot 6 and the lateral engagement of the closing element parts 35, 15 at the hook 4.

Figure 5:
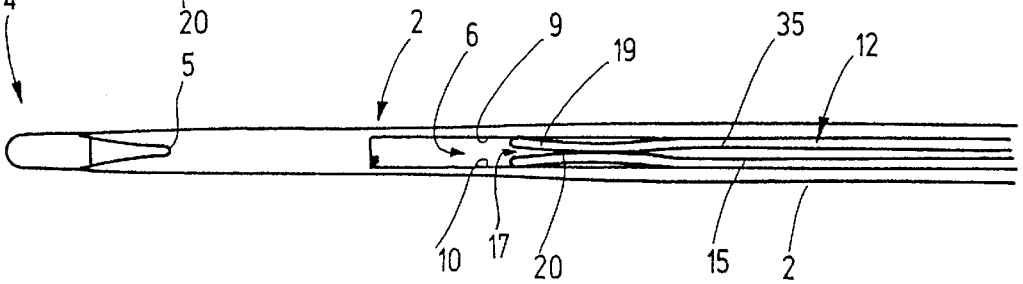
FIG. 5 is a top plan view of the compound needle of FIG. 1, illustrating the closing element in the withdrawn (open) position.

In addition, the closing element may be shifted into the retracted position as illustrated in FIG. 5. During this occurrence the legs 19, 20 enter the closing element slot 6. Because of the narrow opening width of the funnel 17 which only very slightly exceeds, if at all, the distance between the closing element parts 35, 15, the friction of the ends of the legs 19, 20 at the flanks 9 and 10 is only very slight. As a result, the wear is reduced and the closing element 12 runs easily in the closing element slot 6.

Another embodiment of the compound needle according to the invention is illustrated in FIGS. 8–13. Components which are structurally or functionally the same as in the previously described embodiment are given the same reference characters as before.

Figure 8:
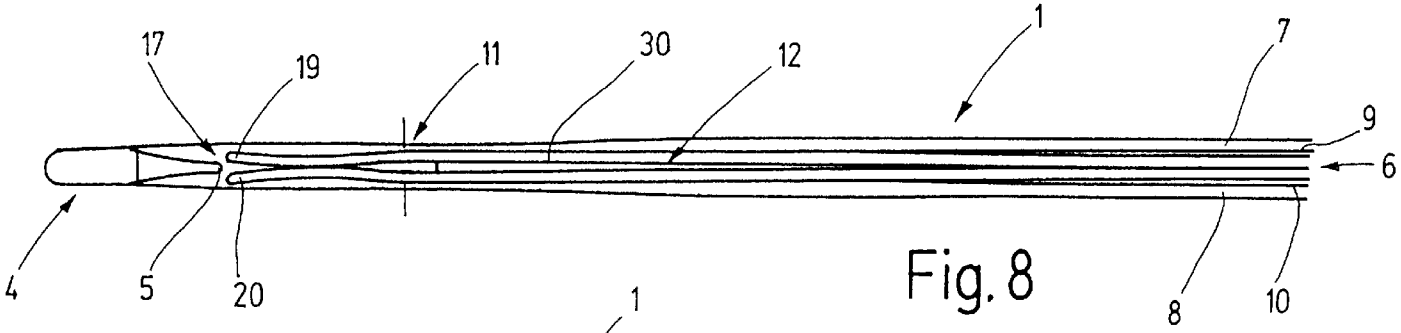
FIG. 8 is a schematic, fragmentary top plan view of another embodiment of the compound needle according to the invention, illustrating the closing element in the hook-closing position.
Figure 9:
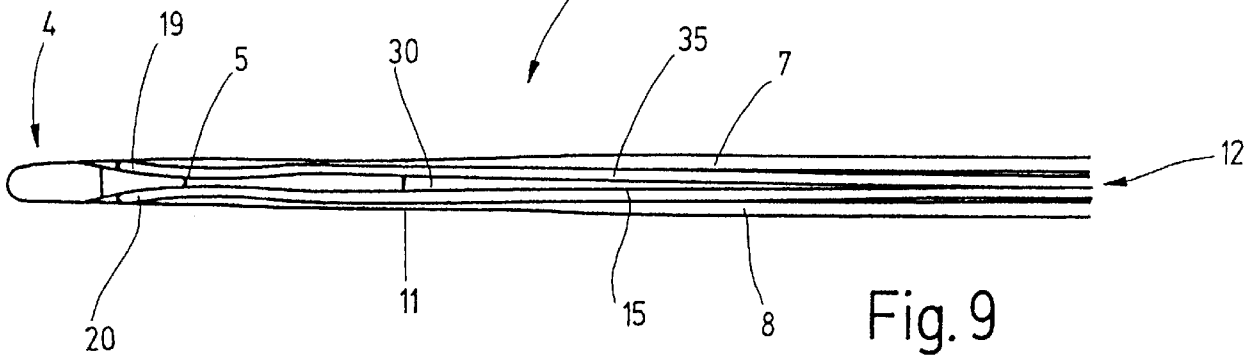
FIG. 9 is a top plan view of the embodiment of FIG. 8, illustrating the closing element in the knockover position.

The difference between the compound needle 1 shown in FIG. 8 and that described earlier resides in the structure of the closing element 12. The closing element parts 35, 15 have only one bending location 22 and thus lack the earlier-described bending location 24. Starting from the bending location 22, the closing element parts 35, 15 extend in the relaxed state linearly away, as it may be particularly well seen for the closing element part 35 in FIG. 13. Such a construction too, leads to a contact of the closing element parts 35, 15 with the flanks 9, 10 of the slot walls 7, 8 in the vicinity or in the immediate proximity of the beginning 11 of the closing element slot. In this manner the closing element 12 is centered and the play between the closing element 12 and the flanks 9, 10 of the closing element slot 6 is compensated for as in the earlier-described embodiment. The play sets itself as the distance 30 between the closing element parts 35, 15.

In this embodiment of the compound needle 1 too, the funnel 17 defined by the legs 19, 20 has a width which is only very slightly greater, if at all, than the diameter of the hook tip 5. If the closing element 12 is shifted from its closing position shown in FIG. 8 into the knockover position according to FIG. 9, the legs 19 and 20 are located beyond the hook tip 5 without having collided therewith. This is achieved by centering the closing element 12 by the supporting locations at which the closing element parts 35, 15 engage the flanks 9, 10. The small distance between the supporting position 14 and the hook tip 5 results in such centering.

Figure 10:
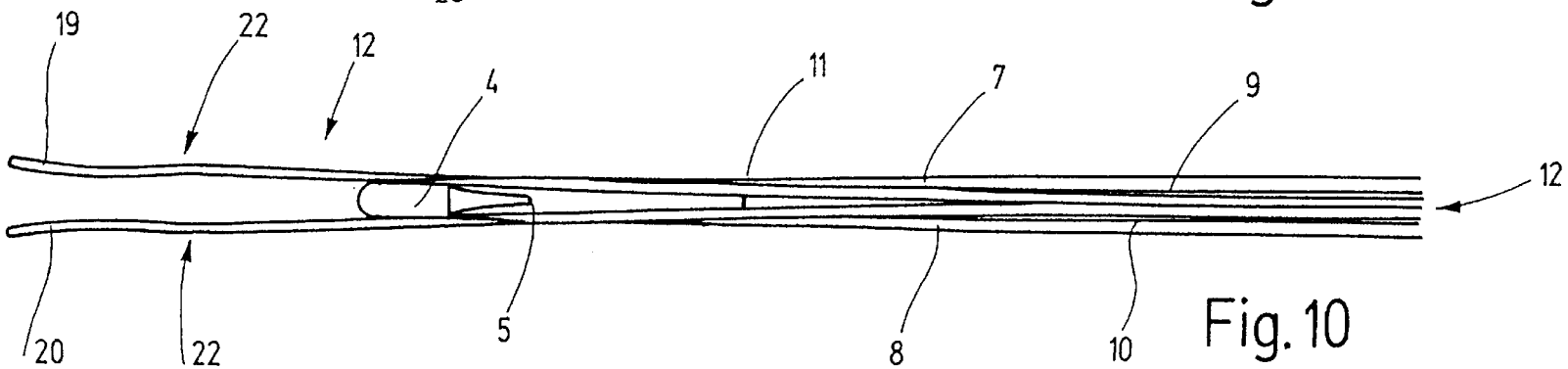
FIG. 10 is a top plan view of the embodiment of FIG. 8, illustrating the closing element in the loop-transfer position.
Figure 11:
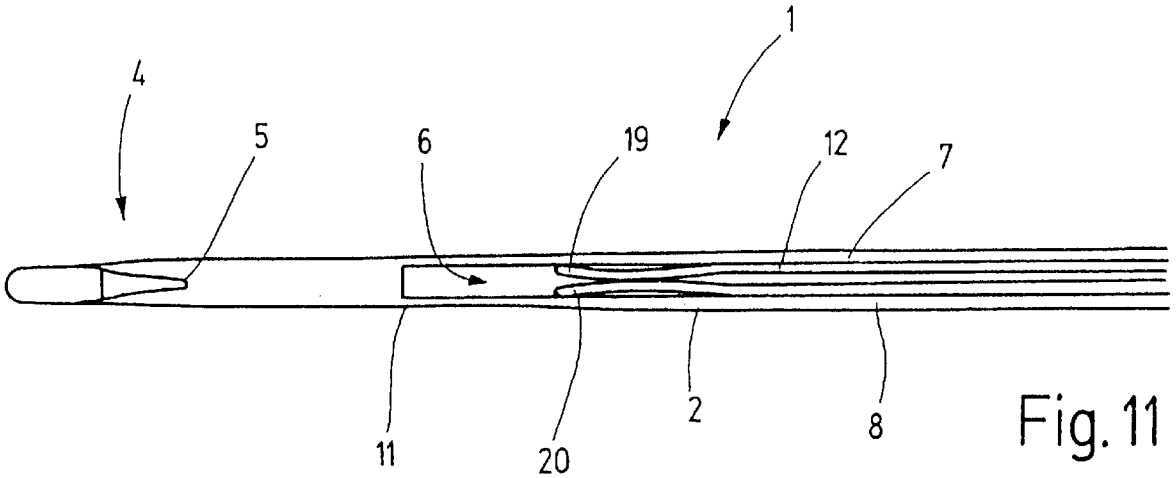
FIG. 11 is a top plan view of the embodiment of FIG. 8, illustrating the closing element in the withdrawn position.
Figure 12:
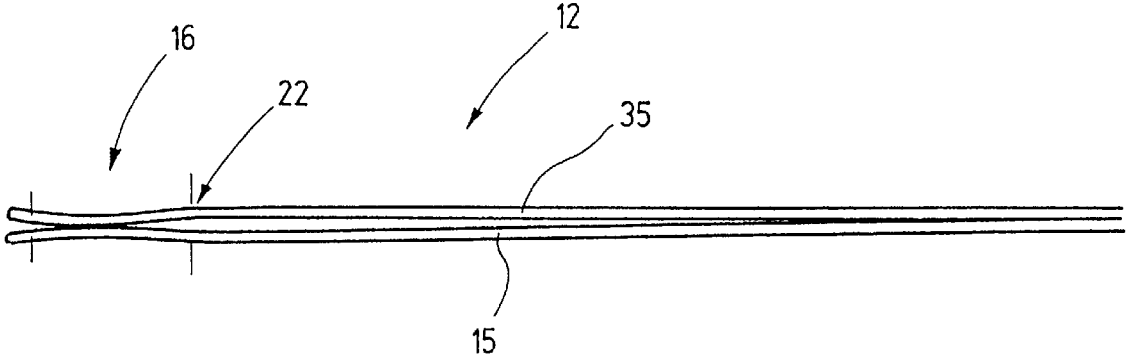
FIG. 12 is a top plan view of the closing element according to the embodiment of FIG. 8.
Figure 13:
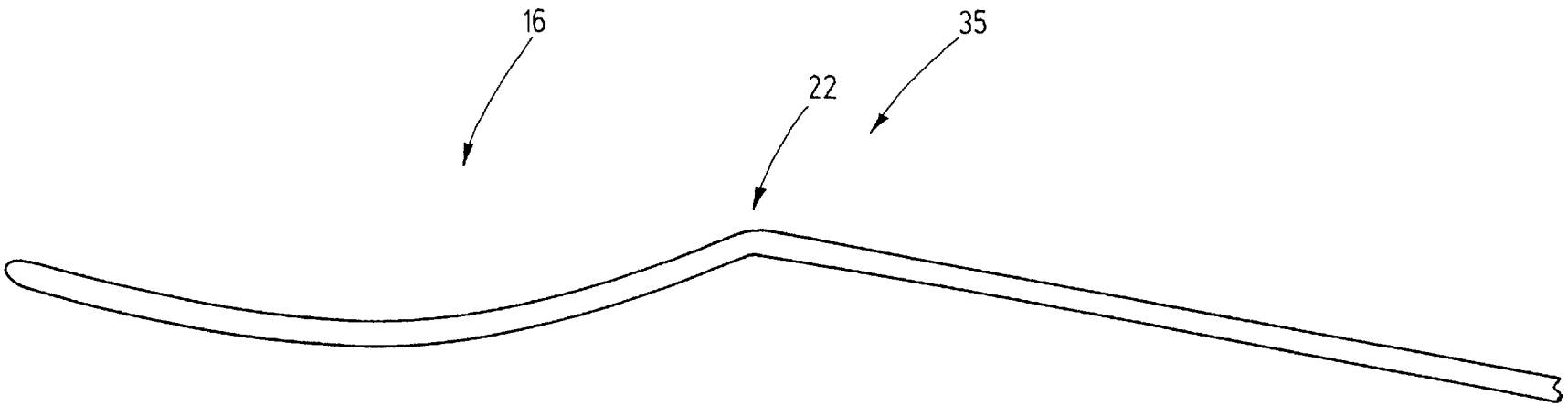
FIG. 13 is a top plan view of one part of the closing element of FIG. 12, shown on an enlarged scale.

Upon a further forward shift of the closing element 12 the transfer position illustrated in FIG. 10 may be assumed. Because of the missing second bending location 24 the ends of the closing element parts 35, 15 projecting beyond the hook 4 form an acute angle with one another.

The opening width of the funnel 17 is significantly less than in conventional compound needles having a divided or slotted closing element. For this reason, the funnel has to be compressed to a significantly lesser extent when it is pulled into the closing element slot 6. As a result, the funnel 17 runs smoothly in the closing element slot 6 with low friction.

It will be understood that the above description of the present invention is susceptible to various modifications, changes and adaptations, and the same are intended to be comprehended within the meaning and range of equivalents of the appended claims.

What is claimed is:

1. A compound needle comprising (a) a shank having an end;

(b) a hook formed on said shank at said end and having a hook tip;

(c) a closing element slot provided in said shank and being defined by two parallel flanks of said shank; said closing element slot extending from a location adjacent said hook in a direction away therefrom; and (d) an elongated closing element received in said closing element slot for longitudinal sliding motions therein; the closing element having a hook-closing position in which said closing element is situated in an immediate vicinity of said hook tip; said closing element being composed of at least two side-by-side disposed, resilient closing element parts each having a free terminal leg oriented toward said hook; said terminal legs being bent away from one another to define a funnel having an open end oriented toward said hook and a beginning spaced from said open end; said closing element parts being bent away from one another from said beginning of said funnel in a rearward direction away from said hook for resiliently contacting respective said flanks at contact locations; said contact locations being situated adjacent said beginning of said closing element slot when said closing element is in said hook-closing position.

2. The compound needle as defined in claim 1, wherein said closing element parts are of symmetrical configuration and arrangement and contact one another at said beginning of said funnel.

3. The compound needle as defined in claim 1, wherein each said closing element part has at least one bend at a location spaced in said rearward direction from said beginning of said funnel; portions in each said closing element part adjoining said bend forming an obtuse angle with one another.

4. The compound needle as defined in claim 1, wherein each said closing element part has a sole bend at a location spaced in said rearward direction from said beginning of said funnel; portions in each said closing element part adjoining said bend forming an obtuse angle with one another.

5. The compound needle as defined in claim 1, wherein each said closing element part has solely two bends at a location spaced in said rearward direction from said beginning of said funnel; portions in each said closing element part adjoining said bends forming an obtuse angle with one another.

6. The compound needle as defined in claim 1, wherein said closing element has a knockover position in which said terminal legs forming said funnel straddle said hook tip.

7. The compound needle as defined in claim 6, wherein said closing element slot has a beginning oriented toward said hook, and further wherein said contact locations are situated at said beginning of said closing element slot in said knockover position.

8. The compound needle as defined in claim 1, wherein said open end of said funnel has an opening width; and further wherein said hook has an arcuate cross-sectional outline having a diameter oriented parallel to said opening width; said opening width having essentially the same size as said diameter.

9. The compound needle as defined in claim 1, wherein said closing element has a transfer position in which said closing element parts extend laterally and beyond said hook; and further wherein each said closing element part has a bend at a location spaced in said rearward direction from said beginning of said funnel; said bend being of such an angle that said closing element parts extend substantially parallel to one another beyond said hook in said transfer position.

10. The compound needle as defined in claim 1, wherein said closing element has a transfer position in which said closing element parts extend laterally and beyond said hook; further wherein regions of said closing element parts forming contact locations in said hook-closing position are situated externally of said closing element slot in said transfer position.

11. The compound needle as defined in claim 5, wherein said closing element has a transfer position in which said closing element parts extend laterally and beyond said hook; and further wherein each said closing element part has a bend at a location spaced in said rearward direction from said beginning of said funnel; said bend being of such an angle that said closing element parts extend substantially parallel to one another beyond said hook in said transfer position.

* * * * *

UNITED STATES PATENT AND TRADEMARK OFFICE

CERTIFICATE OF CORRECTION

PATENT NO. : 6,233,977 B1
DATED : May 22, 2001
INVENTOR(S) : Bernhard Schuler et al.

It is certified that error appears in the above-identified patent and that said Letters Patent is hereby corrected as shown below:

Title page,
Item [73], Assignee: the name should read -- Groz-Beckert KG --.

Signed and Sealed this

Eleventh Day of December, 2001

*Attest:*

Nicholas P. Godici

*Attesting Officer*

NICHOLAS P. GODICI
*Acting Director of the United States Patent and Trademark Office*